US006502344B1

(12) United States Patent
Zeh et al.

(10) Patent No.: US 6,502,344 B1
(45) Date of Patent: Jan. 7, 2003

(54) SAFETY MECHANISM FOR PREVENTING UNAUTHORIZED USE OF A FIREARM

(75) Inventors: Meinrad Zeh, Isny (DE); Gerhard Blenk, Wertach (DE)

(73) Assignee: Blaser Jagdwaffen GmbH, Isny (DE)

( * ) Notice: Subject to any disclaimer, the term of this patent is extended or adjusted under 35 U.S.C. 154(b) by 0 days.

(21) Appl. No.: 09/717,933

(22) Filed: Nov. 21, 2000

(30) Foreign Application Priority Data

Nov. 27, 1999 (DE) ..... 199 57 160

(51) Int. Cl.[7] ..... F41A 17/00
(52) U.S. Cl. ..... 42/70.11; 42/70.01
(58) Field of Search ..... 42/70.11, 70.01, 42/96

(56) References Cited

U.S. PATENT DOCUMENTS 441,240 A * 11/1890 Guptill ..... 215/296
2,836,918 A * 6/1958 Pula et al. ..... 42/1
2,870,794 A * 1/1959 Thaxton ..... 138/90
3,154,874 A * 11/1964 Stewart ..... 42/1
3,193,959 A 7/1965 Jaycox
3,825,146 A * 7/1974 Hirmann ..... 220/24.5
5,044,105 A * 9/1991 Lindley et al. ..... 42/70.11
5,115,589 A * 5/1992 Shuker ..... 42/70.11
5,289,653 A * 3/1994 Szebeni et al. ..... 42/70.11
5,488,794 A * 2/1996 Arrequin ..... 42/70.11
5,664,358 A * 9/1997 Haber et al. ..... 42/70.11
5,699,687 A * 12/1997 Pittman ..... 70/376
5,950,344 A * 9/1999 Ross ..... 42/70.11
6,212,813 B1 * 4/2001 Luna et al. ..... 42/70.11
6,223,566 B1 * 5/2001 Jamison ..... 70/11
6,223,657 B1 * 5/2001 Proffitt ..... 102/444
6,405,472 B1 * 6/2002 Dojcsak ..... 42/70.01

* cited by examiner

*Primary Examiner*—Michael J. Carone
*Assistant Examiner*—M. Thomson
(74) *Attorney, Agent, or Firm*—Flynn, Thiel, Boutell & Tanis, P.C.

(57) ABSTRACT

In order to secure firearms against unauthorized use, an insert is inserted into a portion of the barrel, which insert has an expandable sleeve. A first expanding device is releasably inserted into one end of the expandable sleeve to thus press lockingly against the inside wall of the barrel. A second expanding device is inserted into the other end of the expandable sleeve. When an axial pressure is applied to the second expanding device, the expandable sleeve engages the inside wall of the barrel. The one end of the expandable sleeve is covered with a protective plate which can only be destroyed by spark erosion when the expandable sleeve is removed from the barrel.

20 Claims, 2 Drawing Sheets

SAFETY MECHANISM FOR PREVENTING UNAUTHORIZED USE OF A FIREARM

FIELD OF THE INVENTION

The invention relates to a safety mechanism for preventing unauthorized use of a firearm.

BACKGROUND OF THE INVENTION

The inheritance privilege in the weapon law states that the heirs of a testator, who was authorized to carry a weapon, may legally take ownership of the weapon regardless of whether the heirs are authorized or not to carry a weapon. If one takes note that alone in Germany there are approximately 10 million weapons in private ownership, then this means that a significant risk exists regarding the abuse of such weapons.

To secure a firearm against unauthorized use, it is known to block the barrel by means of a lock, such as a key lock (compare EP 0 959 319 A2). However, this type of lock is not sufficient. Such a lock can be cracked.

A safety mechanism for a firearm is known from the U.S. Pat. No. 3,193,959 which contains an expandable sleeve insertable into the cartridge chamber of the firearm. This expandable sleeve can be pressed against the inside wall of the cartridge chamber by two clamping cones, which can be moved against one another in order to prevent a loading operation. In order to remove such a safety mechanism, however, a pin formed on the locking side of the clamping cone must merely by moved back by a cleaning rod or the like introduced from the front into the barrel, whereby the expandable sleeve is relaxed. This safety mechanism can thus be simply removed even without a special tool.

It would probably be possible to destroy parts of a weapon which are important for the operation of a weapon in order to make such a weapon non-usable. This, however, is not possible when one is dealing with a valuable weapon because one would lose significant value due to the destruction.

SUMMARY OF THE INVENTION

The purpose of this invention is to provide a safety mechanism, which can be released by a man skilled in the art, whereby, however, the attempt to make an unauthorized release results in damage to the weapon. More specifically, and in order to secure firearms against unauthorized use, an insert is inserted into a portion of the barrel, which insert has an expandable sleeve. A first expanding device is releasably inserted into one end of the expandable sleeve to thus press lockingly against the inside wall of the barrel. A second expanding device is inserted into the other end of the expandable sleeve. When an axial pressure is applied to the second expanding device, the expandable sleeve engages the inside wall of the barrel. The one end of the expandable sleeve is covered with a protective plate which can only be destroyed by spark erosion to remove the expandable sleeve from the barrel without damaging the firearm.

The safety mechanism has two functions, whereby the one function can be compared with a straddling dowel and the other function with a blind rivet.

BRIEF DESCRIPTION OF THE DRAWINGS

Exemplary embodiments will be discussed in greater detail hereinafter in connection with the drawing, in which.

DETAILED DESCRIPTION

Figure 1:
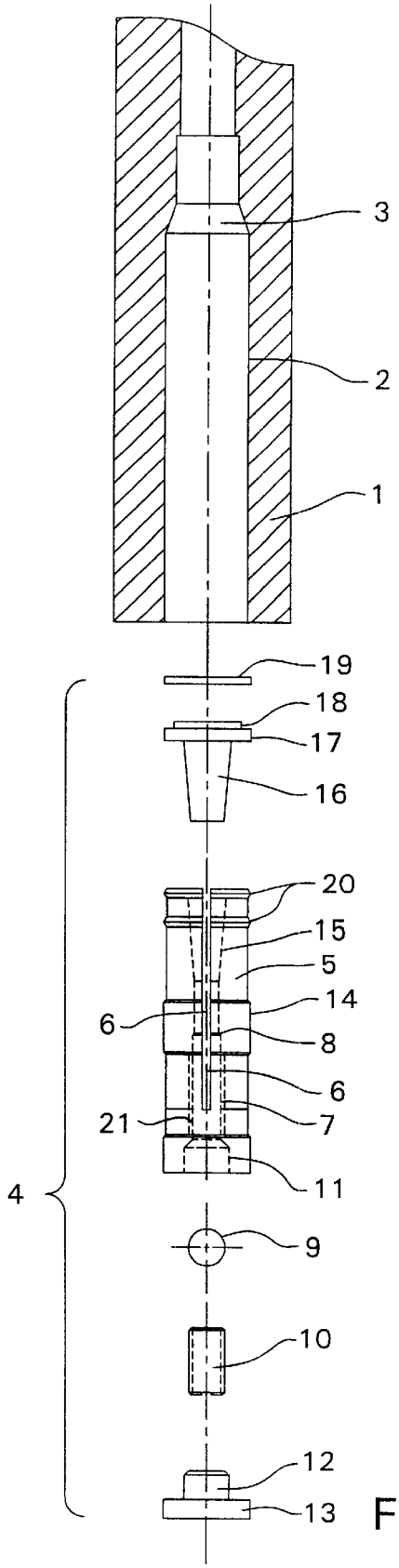
FIG. 1 shows the safety mechanism in an exploded illustration.
Figure 2:
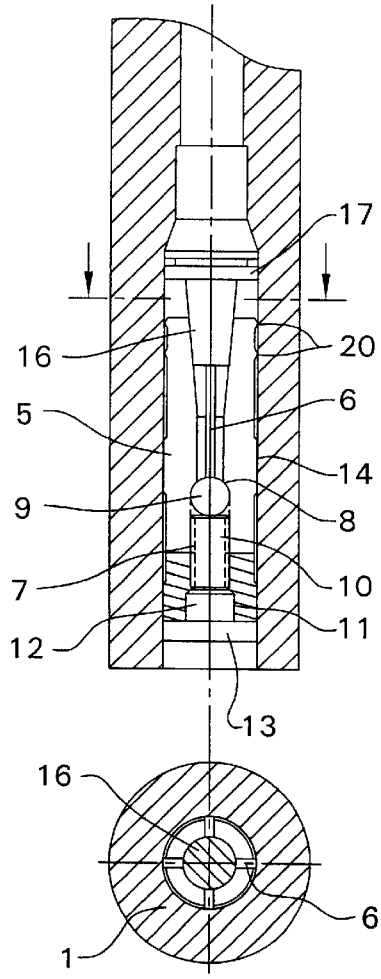
FIG. 2 shows the safety mechanism in use, namely a state wherein it is mounted into the cartridge chamber.

The cartridge chamber 2 with a shoulder 3 is housed in the rear part of the barrel 1 of a weapon. The safety mechanism is to be inserted into this cartridge chamber 2.

The safety mechanism consists of an insert 4 which can be inserted into the cartridge chamber 2. This insert 4 includes an expandable sleeve 5. The expandable sleeve 5 has four slots 6 which are arranged crosswise and extend from the front end into the area of the rear end of the expandable sleeve 5. A hole 21 extends axially and centrally of the expandable sleeve 5 and has an internally threaded part 7 in the rear area, which thread terminates mid-length of the hole at a shoulder 8 projecting into the inside of the hole. A first expanding device can be inserted into the rear end of the expandable sleeve 5, which expanding device consists of a ball 9 and a threaded pin 10. The ball 9 rests on the shoulder 8 in the inserted state. The threaded pin 10 can be screwed into the thread 7.

The rear end of the expandable sleeve 5 has furthermore an entry hole 11 into which a cylindrical shoulder 12 of a protective plate 13 can be inserted. The expandable sleeve 5 has an approximately centrally arranged projecting section 14 mid-length thereof.

The front end part 15 of the hole 21 in the expandable sleeve 5 has a truncated cone shape. A unitary tapered pin 16 having a protective plate 17 is insertable into the truncated cone-shaped hole 15. This protective plate 17 has a peripheral groove 18 which receives therein a gasket 19. The truncated cone-shaped hole 15 and the tapered pin 16 have such a cone angle that, when the tapered pin 16 is driven into the hole 15, they lock together.

The expandable sleeve 5 also has at the front end two axially spaced and radially outwardly projecting, sharp-edge projections 20.

The protective plate 13 with its cylindrical shoulder 12 and the tapered pin 16 with its protective plate 17 are made of a material which resists the attack by commercially available tools, however, can be removed by spark erosion. The material is preferably a hard metal.

To lock the cartridge chamber 2, the tapered pin 16 is inserted into the hole 15 and the gasket 19 is placed onto the peripheral groove 18. The ball 9 is inserted into the hole 21 and the threaded pin 10 is screwed into the hole 21 such that the ball 9 rests loosely against the shoulder 8. The insert 4 is now inserted into the cartridge chamber 2 until the gasket 19 comes to rest on the shoulder 3 of the cartridge chamber 2. The threaded pin 10 is thereafter firmly screwed into the hole 21, which causes the ball 9 to expand the expandable sleeve 5 in its center area through the shoulder 8. The outer cylindrical section 14 will thus rest with pressure on the inwardly facing wall of the cartridge chamber 2. The section 14 can be roughened and may, if necessary, be coated with microcapsules at its surface which contain a 2-component adhesive so that the section 14 additionally adheres to the wall of the cartridge chamber 2.

The cylindrical shoulder 12 is thereafter inserted with a press fit into the hole 11. The diameter of the protective plates 13, 17 are slightly less than the diameter of the cartridge chamber 2. The length of the insert 4 in the assembled state is shorter than the length of the cartridge chamber 2 so that in the inserted state the protective plate 13 is spaced from the rear end into the cartridge chamber 2.

When a striking or pressure tool is introduced into the rear end of the cartridge chamber 2 in order to damage or destroy the protective plate 13, it is then possible that the lock between the section 14 and the wall of the cartridge chamber 2 is overcome, however, the tapered pin 16 penetrates at the same time farther into the hole 15 and thus expands the front end of the expandable sleeve 5. The sharp projections 20 penetrate in this manner into the material of the wall of the cartridge chamber 2 and claw into the material. The cartridge chamber 2 is thus no longer usable.

When the attack is aimed at the protective plate 17, the same type of destruction is accomplished, which means, the front end of the expandable sleeve 5 is expanded.

When the insert 4 is to be authorizedly removed from the cartridge chamber 2, a spark-erosion tool is attached to the protective plate 13 so that the cylindrical shoulder 12 can be removed from the hole 11. The threaded pin 10 is accessible in this manner and can be unscrewed to a point or location where the lock in the section 14 is cancelled.

After the threaded pin 10 has been removed, it is also possible to insert an extractor device into the hole 21 to effect a pulling of the insert 4 rearwardly out of the cartridge chamber 2.

Figure 3:
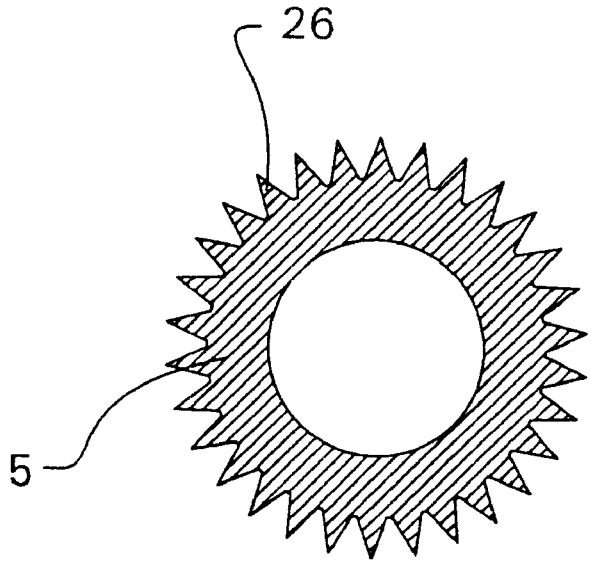
FIG. 3 shows a cross sectional view of the sleeve including sharp-edged teeth.
Figure 4:
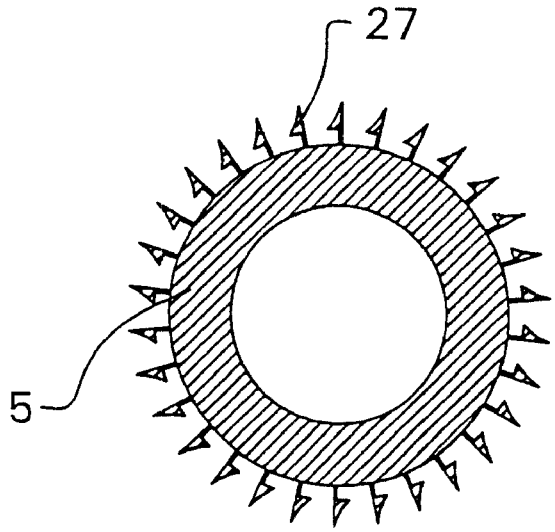
FIG. 4 shows a cross section view of the sleeve including barb-shaped claws.

In one embodiment, shown in FIG. 3, a surface formation of the sleeve 5 comprises sharp-edged teeth 26, which in the expanded state penetrate into the inside wall of the barrel. Likewise, FIG. 4 shows an outer surface formation of the sleeve having barb-shaped claws 27. The teeth 26 and barbs 27 penetrate into the material forming the inside wall of the barrel 1 to prevent movement of the insert 4.

What is claimed is:

1. A safety mechanism for preventing unauthorized use of a firearm, comprising an insert insertable into a portion of a barrel of the firearm, said insert having an expandable sleeve, a first expanding device which is capable of being inserted loosely from one end into the expandable sleeve to effect, in the inserted state, a radially outward pressing of one part of the expandable sleeve against an inside wall of the barrel, a second expanding device capable of insertion at the other end into the expandable sleeve so that upon an application of a pressure in a longitudinal direction along a longitudinal axis of the expandable sleeve, a further part of the expandable sleeve is expanded into engagement with the inside wall of the barrel, and wherein at least one end of said insert has a first protective plate which must be partially destroyed to provide access to the first expanding device.

2. The safety mechanism according to claim 1, wherein the expandable sleeve has plural slots extending in the longitudinal direction, said slots extending from one end of the expandable sleeve to a location spaced from the other end.

3. The safety mechanism according to claim 1, wherein the one part of the expandable sleeve is an approximately centrally arranged section having a roughened exterior surface.

4. The safety mechanism according to claim 1, wherein the first expanding device is capable of being screwed into the expandable sleeve.

5. The safety mechanism according to claim 4, wherein the first expanding device includes a threaded pin which, in the screwed-in state, presses against a ball which abuts against a shoulder which reduces the diameter of a hole in the expandable sleeve.

6. The safety mechanism according to claim 5, wherein the threaded pin has a truncated cone-shaped tip abutting the ball.

7. The safety mechanism according to claim 5, wherein a portion of the shoulder defines an inclined surface.

8. The safety mechanism according to claim 1, wherein the further part of the expandable sleeve is arranged at the other end and includes a surface formation configured to penetrate into the material forming the inside wall of the barrel.

9. The safety mechanism according to claim 8, wherein the surface formation comprises at least one annular sharp-edge projection.

10. The safety mechanism according to claim 8, wherein the surface formation comprises sharp-edge teeth.

11. The safety mechanism according to claim 8, wherein the surface formation comprises barb-shaped claws in the expanded state penetrating into the inside wall of the barrel.

12. The safety mechanism according to claim 1, wherein the second expanding device comprises a tapered pin which rests against an interior wall surface of a truncated cone-shaped hole in the expandable sleeve and, when pressed into the hole, locks to same.

13. The safety mechanism according to claim 12, wherein the other end of the insert is covered by a second protective plate, made of a material which is the same as the material of the first protective plate covering the one end.

14. The safety mechanism according to claim 13, wherein the second protective plate is unitary with the tapered pin.

15. The safety mechanism according to claim 1, wherein the first protective plate has a cylindrical shoulder which is received with a press fit into a hole at one end of the expandable sleeve.

16. The safety mechanism according to claim 1, wherein the insert is configured for insertion into the cartridge chamber.

17. The safety mechanism according to claim 1, wherein said first protective plate comprises a hard metal which must be destroyed by spark erosion to prevent damage to the firearm.

18. The safety mechanism according to claim 1, wherein said first protective plate comprises a hard metal which commercially available tools cannot destroy.

19. A safety mechanism for preventing unauthorized use of a firearm having a barrel, comprising:

an insert insertable into a portion of the barrel of the firearm, said insert having an expandable sleeve, said expandable sleeve having a first end and a second opposing end and an aperture extending through said expandable sleeve and opening at the first and second ends, an inner wall of the aperture at the first end of said expandable sleeve being threaded and the aperture including a shoulder reducing the diameter thereof;

a first expanding device comprising a threaded pin which screws into the threaded inner wall of the aperture at the first end of the expandable sleeve, wherein screwing of said threaded pin into the aperture at the first end presses against a ball that abuts against the shoulder in said expandable sleeve, and causes a first section of said sleeve to expand radially outwardly against a first portion of an inside wall of the barrel of the firearm;

a second expanding device for insertion into the aperture at the second end of said expandable sleeve, wherein insertion of said second expanding device into said aperture at the second end causes a second section of said sleeve to expand radially outwardly into engagement with a second portion of the inside wall of the barrel of the firearm; and a protective plate for covering the first end of said insert to prevent free access to said threaded pin and removal of said safety mechanism from the barrel.

20. A safety mechanism for preventing unauthorized use of a firearm having a barrel, comprising:

an insert insertable into a portion of the barrel of the firearm, said insert having an expandable sleeve, said expandable sleeve having a first end and a second opposing end and an aperture extending through said expandable sleeve and opening at the first and second ends, the aperture at the second end of said expandable sleeve having a truncated cone-shaped section;

a first expanding device for insertion into the aperture at the first end of the expandable sleeve, wherein insertion of said first expanding device into said aperture at the first end causes a first section of said sleeve to expand radially outwardly against a first portion of an inside wall of the barrel of the firearm;

a second expanding device comprising an unthreaded tapered pin for insertion into the cone-shaped section at the second end of said expandable sleeve, wherein the amount of insertion of said second expanding device into said aperture corresponds to an amount of radial outward expansion of a second section of said expandable sleeve into engagement against a second portion of the inside wall of the barrel of the firearm; and a protective plate for covering the first end of said insert and said first expanding device to prevent free access to said first expanding device and said expandable sleeve.

* * * * *